US006922973B1

(12) United States Patent
Hofmann et al.

(10) Patent No.: US 6,922,973 B1
(45) Date of Patent: Aug. 2, 2005

(54) DEVICE AND METHOD FOR PLACING LOOSE SHEET PRODUCTS

(75) Inventors: Frank Hofmann, Oberndorf (DE); Peter Osterberger, Gunzach-Immenthal (DE); Hermann Weilacher, Ampermoching (DE); Frank Werner, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 68 days.

(21) Appl. No.: 10/069,986

(22) PCT Filed: Sep. 6, 2000

(86) PCT No.: PCT/EP00/08699

§ 371 (c)(1),
(2), (4) Date: Jul. 24, 2002

(87) PCT Pub. No.: WO01/19681

PCT Pub. Date: Mar. 22, 2001

(30) Foreign Application Priority Data

Sep. 10, 1999 (DE) ..... 199 43 486

(51) Int. Cl.[7] ..... B65B 13/02; B65B 35/50
(52) U.S. Cl. ..... 53/399; 53/540
(58) Field of Search ..... 53/399, 447, 535, 53/540, 589, 397, 590

(56) References Cited

U.S. PATENT DOCUMENTS 2,923,587 A * 2/1960 Zipf ..... 346/22
4,236,639 A 12/1980 Boettge et al.
4,276,736 A * 7/1981 Haberstroh et al. ..... 53/399
4,369,360 A * 1/1983 Tsuji ..... 235/379
4,538,511 A 9/1985 Wise
4,617,784 A * 10/1986 Golicz et al. ..... 53/540
4,798,316 A * 1/1989 Martin et al. ..... 232/43.1
4,977,827 A 12/1990 Chandhoke et al.
5,074,739 A * 12/1991 Takahashi et al. ..... 414/412
5,346,206 A 9/1994 Steinhart
5,575,612 A 11/1996 Uno
5,996,314 A * 12/1999 Pennini et al. ..... 53/399
6,513,303 B2 * 2/2003 Neri ..... 53/399
6,550,221 B1 * 4/2003 Neri ..... 53/399

FOREIGN PATENT DOCUMENTS

DE 4328136 3/1995

* cited by examiner

*Primary Examiner*—Eugene Kim
*Assistant Examiner*—Paul Durand
(74) *Attorney, Agent, or Firm*—Bacon & Thomas, PLLC

(57) ABSTRACT

The invention relates to an apparatus for depositing loose sheet material, in particular papers of value, bank notes, etc., having a transport apparatus (2) for transporting the sheet material (1) and a stacking unit (3) for depositing the bank notes (1) in a deposit device as well as a strapping unit (7). In such deposit apparatuses it is usual to provide special deposit devices for depositing loose and strapped sheet material, said devices consequently not being interchangeable.

It is therefore the problem of the invention to state an apparatus and method for providing a flexible possibility of depositing sheet material. This is obtained by using a deposit device which is suitable for optionally depositing loose and/or strapped sheet material (1).

13 Claims, 2 Drawing Sheets

DEVICE AND METHOD FOR PLACING LOOSE SHEET PRODUCTS

BACKGROUND OF THE INVENTION

This invention relates to an apparatus and method for depositing loose sheet material.

In bank note processing machines it is known to deposit checked bank notes in bins in either loose or strapped form. German laid-open print DE 27 29 830 A1 discloses a bank note processing machine wherein the bank notes intended for processing arrive for example in packets. By means of a transport unit the packets are first supplied to an apparatus for removing straps and singling. Further, the bank notes are subjected to a precheck for rejecting those bank notes or papers of value which could cause damage when running through the transport unit. Further, the bank notes are checked for their fitness for circulation and authenticity. In a following unit, authentic bank notes unfit for circulation are supplied to a shredder system. The bank note processing machine further contains modules working in tandem operation for stacking and unstrapped deposit of bank notes unfit for circulation in specially provided bins as well as units likewise working in tandem operation for stacking and strapped deposit of bank notes fit for circulation, said unit having a strapping station associated therewith. A further unit is provided for depositing bank notes in a reject or manual reworking magazine.

The disadvantage of the bank note machine disclosed in DE 27 29 830 A1 is that separate units which are not interchangeable are provided for strapped and unstrapped deposit of bank notes.

SUMMARY OF THE INVENTION

It is therefore an objective of the invention to state an apparatus and method which provide a flexible possibility for depositing sheet material.

According to an apparatus of the invention, it is provided that the deposit device is suitable for optionally depositing loose and/or strapped sheet material. Accordingly, a method of the invention provides that the sheet material can be deposited optionally in loose or strapped form in one type of bin.

The invention achieves the objective in that the deposit units for loose and strapped sheet material deposit are interchangeable. This leads to lower production costs since the deposit apparatuses can be produced in larger numbers of pieces due to the optional use.

According to an advantageous embodiment of the invention, the deposit apparatus contains a movable plate. In a first operating mode intended for strapped deposit of bank notes or papers of value, said movable plate is disposed above a deposit bin while, in a second operating mode intended for loose deposit of sheet material, it is disposed outside the area of the deposit bin to permit direct deposit of sheet material in the deposit bin via a displaceable bottom.

This results in an apparatus which also permits, for strapped deposit of sheet material, the latter to be first stacked on the plate in order to be supplied to a strapping unit.

It has further proved advantageous to dispose the strapping unit in swiveling fashion in a door of the apparatus. This assembly facilitates both the changing of strapping material and the elimination of errors or disturbances in operation, since swiveling out the strapping unit makes both the strapping unit and the deposit unit easily accessible. Further, changing the entire door with the strapping unit facilitates service.

According to a further advantageous embodiment of the inventive apparatus, the deposit device can be executed as a tandem unit with two deposit bins, each deposit bin having a stacking unit associated therewith. This means that the operation of the bank note processing machine need not be interrupted for a change of bin. When one bin is full the sheet material is supplied to the other stacking unit and thus the other deposit bin.

It is further provided to dispose at least one sensor in the deposit device for determining the height of the already deposited stack of sheets or the distance of the sheet material from the stacking wheel. Said sensor can firstly be used to ascertain how much sheet material can still be deposited in the bin before it is necessary to switch to the other. Secondly, the bottom, which is vertically displaceable according to a further advantageous embodiment of the apparatus, can, when a certain fill level has been reached, be lowered so far that there is enough room to receive a strapped packet or a predetermined quantity of loose sheet material in the bin without the height of fall to the bottom or to the sheet material already located in the bin becoming too great. An excessive height of fall could result in a packet canting or in irregular deposit of loose sheet material. A further sensor is preferably disposed in the lower moving area of the vertically displaceable bottom (lift), said sensor being used both for initializing the lift and as a reference for the residual fill level in the deposit bin.

It has proved advantageous in particular for the deposit of strapped packets if the displaceable bottom is lowered in steps, the lowering being effected in roughly the thickness of one packet at a time.

Stepwise lowering is likewise possible for loose stacking, it also being advantageous for this type of stacking to lower the bottom continuously so that the loose sheet material can be brought into the deposit bin with a very low height of fall.

The inventive apparatus further provides that the deposit bin is formed as a removal aid for removing a stack of sheets from the deposit device for them to be transferred to corresponding bins in accordance with the further processing or use of the sheet material. The deposit bin can be formed as a safety bin in particular if bank notes are to be deposited therein.

In particular if the deposit bin is formed as a removal aid, the inventive apparatus can be used in advantageous fashion to deposit the sheet material in a single bin in mixed form, i.e. both loose and strapped, it being separated only in later processing or use. This is of advantage in particular for smaller bank note processing machines, since there is no need for several different deposit devices in this case but the total sheet material can be deposited in a single bin, which might also be formed as a tandem unit.

For strapping, it is advantageous if a movable clamping apparatus is disposed above the movable plate. Said movable clamping apparatus is lowerable onto the stack of sheet material so that sheet material deposited on the movable plate for strapping can be held reliably when being supplied to the strapping unit. Alternatively, sheet material can be supplied to the strapping unit by means of a gripper.

A further advantage is obtained if a printer is disposed before the strapping unit for printing the strap with data relating to the sheet material. This permits the data relating to the packet of sheet material to be applied after preparation of the packet. This has the advantage of facilitating error processing, if for example the packet contains contains too few bank notes or other disturbances have occurred. According to the invention the print data are only applied when a packet has been properly supplied to the strapping unit.

Besides the apparatus, the invention also provides a method for depositing loose sheet material which is likewise characterized in that the deposit of sheet material can be effected optionally in loose or strapped form in a single type of bin.

An advantageous embodiment of said method provides that, for strapped deposit, a movable plate is positioned above the deposit bin, the sheet material being deposited on said plate until a predetermined number of sheets or predetermined stack height has been reached. In areas of said predetermined number of sheets or predetermined stack height a clamping apparatus can be lowered onto the stack of sheets to hold the deposited sheet material firmly on the movable plate, thereby permitting reliable supply to a strapping unit. After strapping, which is done by drawing the strap over the packet of sheet material and the movable plate, the movable plate is withdrawn and the stack of sheets is stripped above the deposit bin. Alternatively, the sheet material can be supplied to the strapping unit by means of a gripper.

For loose stacking, the method provides that the movable plate is brought into a position outside the area of the deposit bin so that the bin is exposed and the loose sheet material can be deposited directly in the bin. Advantageously, a sensor is then used to evaluate what height is available between the upper edge of the bin and the bottom of the bin or the deposited sheet material. This permits the lowering of the movable bottom to be regulated so that the bottom is lowered so far that the height of fall of loose or strapped sheet material via the reception of a predetermined quantity is sufficient but nevertheless not too great.

BRIEF DESCRIPTION OF THE DRAWINGS

In the following, the invention will be explained in more detail with reference to FIGS. 1 to 5, in which.

DETAILED DESCRIPTION OF THE INVENTION

Figure 1:
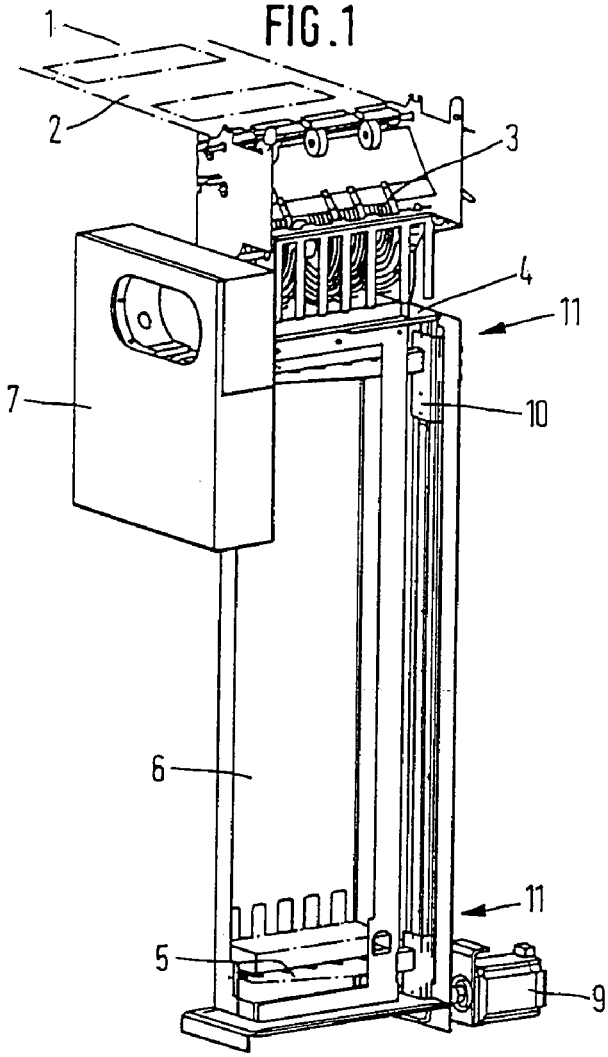
FIG. 1 shows a schematic representation of the inventive apparatus.

FIG. 1 shows the inventive apparatus for depositing loose sheet material 1. To make it easier, the representation of housing parts has been omitted. Loose sheet material 1 is supplied by means of transport path 2 to stacking unit 3. Stacking unit 3 substantially comprises a stacker drum having spiral-shaped dividers to form the individual slots. The stacker drum has associated therewith a stripper which removes the bank notes from the stacker drum and deposits them on collecting plate 4 in the position of said plate 4 shown in FIG. 1.

Disposed below stacking unit 3 or collecting plate 4 is bin 6 whose bottom 5 is designed as displaceable bottom (lift). The displaceable bottom is displaced vertically by means of driving motor 9 and driving mechanism 10. FIG. 1 further shows areas 11 in which one or more sensors can be disposed for detecting the height of the stacked sheet material and providing accordingly detected signals to an evaluation unit not shown in the figure. The evaluation unit drives driving motor 9 for displaceable bottom 5. The evaluation unit can be formed e.g. by a microcomputer. For initializing the lift and as a reference for the residual fill level.

FIG. 1 further shows strapping unit 7 which is disposed schematically on the deposit apparatus. Strapping unit 7 is preferably executed to swivel in the form of a door of the housing not shown. This execution of strapping unit 7 allows both easy changing of the strapping material and easy access to stacking unit 3 or bin 6, permitting disturbances in the operating sequence to be easily eliminated. Strapping unit 7 can further be provided with a viewing window or viewing slit on the outside so that the supply of strapping material is also readily recognizable. Disturbances can advantageously be eliminated by replacing the door together with strapping unit 7 by another door with another strapping unit.

Figure 2:
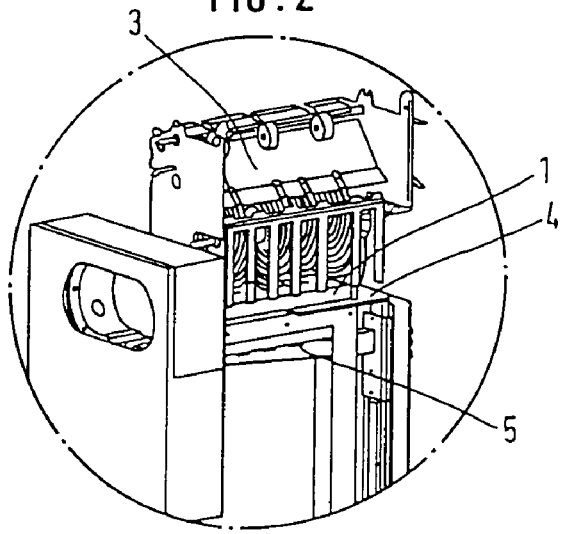
FIG. 2 shows a detail of FIG. 1 for strapped stacking in the initial position.

FIG. 2 shows a detail of FIG. 1 showing in particular stacking unit 3 and the upper area of bin 6. In FIG. 2 displaceable bottom 5 is in its initial position, i.e. the bottom is moved up as far as collecting plate 4, i.e. to the upper stop point.

FIG. 2 shows the initial position of a first operating mode for depositing packets of bank notes or papers of value to be strapped, wherein collecting plate 4 is disposed above bin 6 or above lift 7 or below stacking unit 3.

During operation for strapped deposit, sheet material is deposited by stacking unit 3 on collecting plate 4 until the stack of sheets has reached a certain predetermined height or, as is usually the case in bank note processing for example, until a certain number of bank notes, for example one hundred bank notes, is disposed on collecting plate 4.

Figure 3:
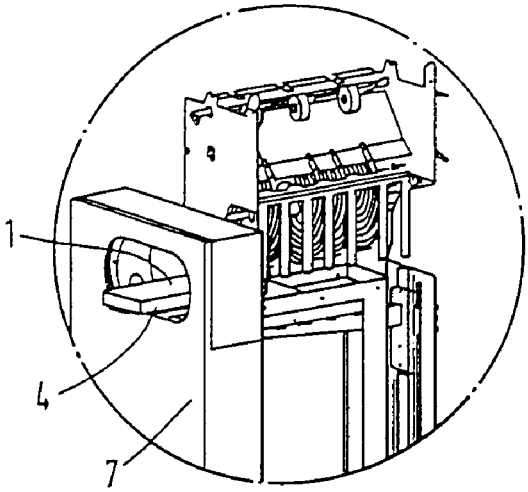
FIG. 3 shows the same detail when strapping a packet of sheet material.

FIG. 3 shows the next step in which a packet of bank notes 1 is moved by means of collecting plate 4 into strapping unit 7. To prevent bank notes 1 from slipping during the moving of collecting plate 4, a clamping apparatus not shown can be used for urging bank notes 1 against collecting plate 4. In strapping unit 7 the packet is provided with a strap which surrounds both the sheet material and collecting plate 4. Strapping unit 7 can further be provided with a printing device not shown in the figure, so that the print data relating to the strapped packet of sheet material can advantageously be applied to the strap directly during or after strapping.

Figure 4:
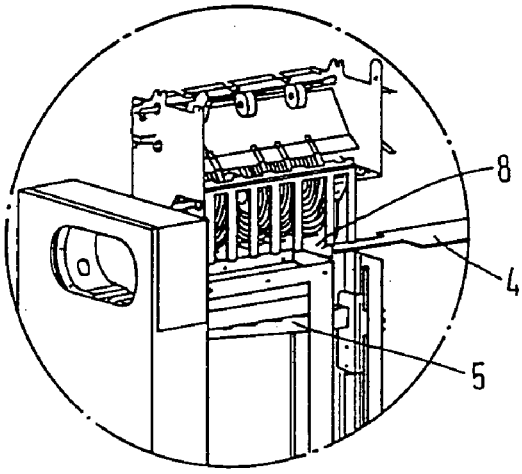
FIG. 4 shows the detail with the displaceable plate moved out.

In the next step, shown in FIG. 4, movable plate 4 including strapped packet 1 has been moved back, collecting plate 4 being moved outside the area of stacking unit 3 or bin 6. The strapped packet was held within the deposit area by means of stripper 8 so that it could fall onto movable bottom 5 in bin 6. Movable bottom 5 has meanwhile been moved downward by the stack height of one packet so that the packet stripped by stripper 8 has found room in the bin.

Figure 5:
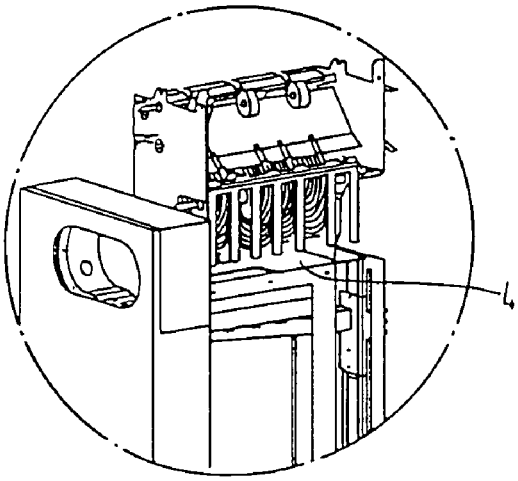
FIG. 5 shows the detail again in the initial position.

FIG. 5 shows a position corresponding to FIG. 2, the only difference being that a deposited packet is already disposed on movable bottom 5 which is displaced downward by the stack height of one packet.

In a second operating mode for depositing loose bank notes or papers of value, collecting plate 4 is brought into a position outside the area of deposit bin 6, as shown e.g. in FIG. 4. The bank notes are then deposited directly onto bottom 5 or onto the bank notes or bundles of bank notes already deposited there before. The continuous or stepwise lowering of bottom 5 is controlled by means of the sensor described above.

What is claimed is:

1. A method for selectively depositing loose and strapped sheet material, wherein sheet material is supplied by means of a transport unit to a stacking unit which deposits the sheet material in a deposit unit, comprising the step of: selectively depositing the sheet material in loose and strapped form in a deposit bin of the deposit unit;

wherein:

for a strapped deposit, a movable plate is positioned above the deposit bin, and the sheet material is deposited on said plate until a predetermined number of sheets or predetermined stack height has been reached, the deposited sheet material is held on the movable plate and guided into a strapping unit with a clamping apparatus or transported into the strapping unit by means of a gripper, and the movable plate is withdrawn and the stack of strapped sheets is released into the deposit bin.

2. The method according to claim 1, wherein the movable plate is positioned outside the area of the deposit bin for loose deposit of sheet material in the deposit bin.

3. The method according to claim 1, including using a sensor to evaluate the height the deposited sheet material occupies within the deposit bin and in accordance with the evaluation lowering a displaceable bottom of the deposit bin sufficiently so that there is enough room for depositing a packet of strapped sheet material or a predetermined quantity of loose sheet material in the bin.

4. Apparatus for selectively depositing loose and strapped sheet material, comprising:

a transport apparatus arranged to transport loose sheet material;

a stacking unit positioned to receive and stack loose sheet material from the transport apparatus;

a strapping unit arranged to receive a stack of loose sheet material from the stacking unit and strap a stack of loose sheet material, the strapping unit located generally adjacent the stacking unit;

a deposit bin arranged to selectively receive sheet material strapped by the strapping unit and loose sheet material from the stacking unit, the deposit bin located below the stacking unit; and a movable plate for selectively depositing sheet material into the deposit bin and diverting sheet material to the strapping unit, the movable plate operable between two modes, wherein in the first mode the movable plate is positioned in a first area below the stacking unit and above the deposit bin for diverting sheet material to the strapping unit, and in the second mode the movable plate is positioned outside the first area for permitting direct deposit of sheet material into the deposit bin via the stacking unit.

5. Apparatus according to claim 4, wherein the strapping unit is arranged in swiveling fashion in a door of the apparatus.

6. Apparatus according to claim 4, wherein the apparatus is configured as a tandem unit having two deposit bins each having a stacking unit associated therewith.

7. Apparatus according to claim 4, wherein the deposit bin includes a sensor arranged to determine the height of a stack of loose sheet material deposited therein.

8. Apparatus according to claim 7, wherein the deposit bin contains a vertically displaceable bottom which is displaceable in dependence on the sensor evaluation and a selected operating mode.

9. Apparatus according to claim 8, wherein the displaceable bottom is lowered in steps in the operating mode for strapped deposit.

10. Apparatus according to claim 8, wherein the displaceable bottom is lowerable continuously or in steps in the operating mode for loose stacking.

11. Apparatus according to claim 4, including a movable clamping apparatus disposed above the movable plate, said clamping apparatus being lowerable onto a stack of sheet material and arranged to deliver the stack to the strapping unit.

12. Apparatus according to claim 4, including a gripper arranged to transport the sheet material into the strapping unit.

13. Apparatus according to claim 4, wherein the strapping unit includes a printer for printing the strap with data relating to the sheet material.

* * * * *